US009163854B2

(12) United States Patent
Arbucci

(10) Patent No.: US 9,163,854 B2
(45) Date of Patent: Oct. 20, 2015

(54) WINDOW SUPPORT AND METHOD FOR ROOM AIR CONDITIONER INSTALLATION

(71) Applicant: Ernest Arbucci, Melville, NY (US)

(72) Inventor: Ernest Arbucci, Melville, NY (US)

(73) Assignee: TopShelf A/C Corp., Melville, NY (US)

( * ) Notice: Subject to any disclaimer, the term of this patent is extended or adjusted under 35 U.S.C. 154(b) by 0 days.

(21) Appl. No.: 14/505,035

(22) Filed: Oct. 2, 2014

(65) Prior Publication Data

US 2015/0097096 A1 Apr. 9, 2015

Related U.S. Application Data

(60) Provisional application No. 61/888,163, filed on Oct. 8, 2013.

(51) Int. Cl.

| | |
|---|---|
| ***F24F 13/32*** | (2006.01) |
| ***E04B 1/41*** | (2006.01) |
| ***E06B 7/28*** | (2006.01) |
| ***F24F 1/02*** | (2011.01) |
| ***E04G 3/18*** | (2006.01) |
| ***A47F 3/02*** | (2006.01) |
| *E04B 1/38* | (2006.01) |

(52) U.S. Cl.

CPC . *F24F 13/32* (2013.01); *A47F 3/02* (2013.01); *E04B 1/40* (2013.01); *E04G 3/18* (2013.01); *E06B 7/28* (2013.01); *F24F 1/027* (2013.01); *E04B 2001/405* (2013.01)

(58) Field of Classification Search

CPC ..... E04G 3/18; F24F 1/027; F24F 13/32; A47L 3/02

USPC ..... 248/208, 236, 674, 678

See application file for complete search history.

(56) References Cited

U.S. PATENT DOCUMENTS

| | | | | | |
|---|---|---|---|---|---|
| 194,718 | A | * | 8/1877 | Palmer | 182/57 |
| 274,334 | A | * | 3/1883 | Hurley | 182/57 |
| 399,491 | A | * | 3/1889 | Bukawietis | 182/62 |
| 495,810 | A | * | 4/1893 | Iseminger | 182/59 |
| 593,501 | A | * | 11/1897 | Timmis | 182/57 |
| 598,860 | A | * | 2/1898 | Dean | 182/62 |
| 652,010 | A | * | 6/1900 | Wheeler | 248/236 |
| 660,174 | A | * | 10/1900 | Tischer | 182/59 |
| 795,451 | A | * | 7/1905 | Rice | 182/61 |
| 823,921 | A | * | 6/1906 | Christopherson | 182/62 |
| 829,537 | A | * | 8/1906 | Millis | 182/61 |
| 917,175 | A | * | 4/1909 | Smith | 182/58 |
| 1,142,596 | A | * | 6/1915 | Mangisch | 182/56 |
| 1,275,053 | A | * | 8/1918 | Leiding | 52/37 |
| 1,321,869 | A | * | 11/1919 | Wilson | 182/100 |
| 1,336,283 | A | * | 4/1920 | Cook | 182/57 |
| 1,512,792 | A | * | 10/1924 | Nelson | 182/61 |
| 1,517,585 | A | * | 12/1924 | Richardson | 182/58 |

(Continued)

*Primary Examiner* — Terrell McKinnon
*Assistant Examiner* — Eret McNichols
(74) *Attorney, Agent, or Firm* — Collard & Roe, P.C.

(57) ABSTRACT

A bracket for mounting an air conditioning unit in a window has a base plate having a front edge and a rear edge and a pair of support legs connected to the base plate and extending from the rear edge, each support leg having an end face that faces in a same direction as the front edge and a support trough connected to the front edge. There are adjustable arms connected to the support trough. These arms are slidable in opposite directions to increase the width of the bracket and fit it exactly to the width of the window frame. When the bracket is positioned in a window frame of a structure, the support trough fits within the window frame and the end faces of the each support leg rest against an exterior of the structure.

10 Claims, 5 Drawing Sheets

(56) References Cited

U.S. PATENT DOCUMENTS

| | | | | | |
|---|---|---|---|---|---|
| 1,518,091 | A | * | 12/1924 | Mathis et al. | 52/37 |
| 1,531,159 | A | * | 3/1925 | Timmons | 248/236 |
| 1,601,471 | A | * | 9/1926 | Fowler | 182/62 |
| 1,625,423 | A | * | 4/1927 | Peckenpaugh | 182/62 |
| 1,627,241 | A | * | 5/1927 | Johnson | 248/236 |
| 1,658,942 | A | * | 2/1928 | Renstrom | 182/61 |
| 1,663,279 | A | * | 3/1928 | Portt | 182/62 |
| 1,679,961 | A | * | 8/1928 | Embrey | 182/57 |
| 1,701,301 | A | * | 2/1929 | Goodwin | 248/240.3 |
| 1,711,354 | A | * | 4/1929 | King | 182/60 |
| 1,823,771 | A | * | 9/1931 | Thrasher | 182/62 |
| 1,894,878 | A | * | 1/1933 | La Grange | 182/61 |
| 1,949,820 | A | * | 3/1934 | Timmons | 182/59 |
| 1,957,184 | A | * | 5/1934 | Smith | 248/236 |
| 2,037,438 | A | * | 4/1936 | Roth | 182/53 |
| 2,049,353 | A | * | 7/1936 | Cary | 182/62 |
| 2,059,739 | A | * | 11/1936 | Ment et al. | 182/61 |
| 2,116,427 | A | * | 5/1938 | Loman | 182/60 |
| 2,219,642 | A | * | 10/1940 | Whiteman | 182/60 |
| 2,273,370 | A | * | 2/1942 | Oberti | 182/58 |
| 2,292,379 | A | * | 8/1942 | Jirasek | 182/62 |
| 2,420,635 | A | * | 5/1947 | Workman | 182/61 |
| 2,568,968 | A | * | 9/1951 | Perrin | 248/236 |
| 2,583,613 | A | * | 1/1952 | Talbott | 49/465 |
| 2,678,243 | A | * | 5/1954 | Masse | 182/120 |
| 2,717,139 | A | * | 9/1955 | Jewell | 248/208 |
| 2,723,885 | A | * | 11/1955 | Dietz | A47L 3/02 182/129 |
| 2,736,615 | A | * | 2/1956 | Gormley | 182/55 |
| 2,758,456 | A | * | 8/1956 | Wheeler | 62/262 |
| 2,891,754 | A | * | 6/1959 | Kuhlenschmidt et al. | 248/208 |
| 2,935,284 | A | * | 5/1960 | Reeves | 248/208 |
| 2,978,973 | A | * | 4/1961 | Sweedyk et al. | 62/262 |
| 3,010,534 | A | * | 11/1961 | Borke | 182/58 |
| 3,257,933 | A | * | 6/1966 | Baylinson | 454/203 |
| 3,273,843 | A | * | 9/1966 | Bell, Jr. et al. | 248/208 |
| 3,394,910 | A | * | 7/1968 | Ulich | 248/208 |
| 3,727,721 | A | * | 4/1973 | Kulesa | 182/62 |
| 5,112,015 | A | * | 5/1992 | Williams | 248/236 |
| 5,203,426 | A | * | 4/1993 | Sydnor | 182/57 |
| 5,636,816 | A | | 6/1997 | Burton et al. | |
| 5,823,289 | A | * | 10/1998 | Csomos | 182/61 |
| 5,967,478 | A | * | 10/1999 | Tynes | 248/241 |
| 6,173,930 | B1 | | 1/2001 | Arbucci | |
| 6,233,877 | B1 | * | 5/2001 | Monroe | 52/37 |
| 6,367,750 | B1 | * | 4/2002 | Ford | 248/208 |
| 6,731,250 | B1 | * | 5/2004 | Berman | 343/878 |
| 6,767,278 | B1 | * | 7/2004 | Peterson | 454/196 |
| 7,753,334 | B2 | * | 7/2010 | Schreiber | 248/351 |
| 8,091,844 | B1 | * | 1/2012 | Bragg | 248/208 |
| 8,167,260 | B2 | | 5/2012 | Boccia et al. | |
| 8,584,998 | B1 | * | 11/2013 | Peterson | 248/208 |
| 8,657,131 | B2 | * | 2/2014 | Pixler | 211/123 |
| 2010/0270448 | A1 | * | 10/2010 | Boccia et al. | 248/208 |
| 2011/0073746 | A1 | * | 3/2011 | Padiotis | 248/674 |
| 2012/0137499 | A1 | * | 6/2012 | Agnihotri | 29/462 |
| 2014/0090334 | A1 | * | 4/2014 | Darby et al. | 52/741.1 |
| 2015/0034784 | A1 | * | 2/2015 | Darby | 248/236 |

* cited by examiner

WINDOW SUPPORT AND METHOD FOR ROOM AIR CONDITIONER INSTALLATION

CROSS REFERENCE TO RELATED APPLICATIONS

Applicant claims priority under 35 U.S.C. §119(e) of U.S. Provisional Patent Application No. 61/888,163 filed Oct. 8, 2013, the disclosure of which is incorporated by reference.

BACKGROUND OF THE INVENTION

1. Field of the Invention

The present invention relates to a bracket for mounting a window air conditioner unit, and a method for mounting the air conditioning unit in a window. In particular, the invention relates to a bracket that enables air conditioners of various sizes to be securely mounted in a window frame without the need for shims or other adjustment devices.

2. The Prior Art

Window air conditioners are commonly used in older buildings that are not equipped with central air conditioning ducts, or in locations where the need for air conditioning is restricted to a very small window of time. These window units are convenient because they can be installed and removed without affecting the building, and can be moved to different rooms based on need. However, window units are very heavy, and are not always perfectly sized for the window opening. As a result, the units are not always securely mounted in the window. In addition, if the unit is too small, air gaps can form around the unit and reduce its cooling effect. Several attempts have been made to create brackets for securing the air conditioning unit in place. However, these often require permanently affixing the bracket to the building via screws, bolts, etc.

SUMMARY OF THE INVENTION

It is therefore an object of the invention to provide a bracket and method for mounting a window air conditioner, in which the bracket can be adjusted for fitting air conditioners of all sizes. It is another object of the invention to provide a bracket and method that does not require any tools to install, or permanent changes to the building.

This and other objects are accomplished by a bracket for mounting an air conditioning unit in a window, comprising a base plate having a front edge and a rear edge, a pair of support legs connected to the base plate and extending from the rear edge, each support leg having an end face that faces in a same direction as the front edge and a support trough connected to the front edge. There are adjustable arms connected to the support trough. These arms are slidable in opposite directions to increase the width of the bracket and fit it exactly to the width of the window frame. When the bracket is positioned in a window frame of a structure, the support trough fits within the window frame and the end faces of the each support leg rest against an exterior of the structure.

The support legs have an adjustable length so that the bracket can be positioned to exactly fit the window and structure on which it is mounted. In one embodiment, each support leg is formed by two telescoping parts, and the length of each support leg is adjustable by adjusting a position of the telescoping parts relative to one another. This way, the bracket can be adjusted for various structures, where distance between the interior opening and the exterior wall can vary. Once the length of the support legs is set, the parts can be fixed in place by any suitable means, such as by pins.

The support legs are configured to be generally U-shaped, with a horizontal upper portion portion, a vertical portion connected to the horizontal portion and extending downward, and a diagonal portion connected to the horizontal portion, extending inward, and terminating in the end face. Thus, the end face extends substantially perpendicular to the horizontal portion.

The end face can be formed by a separate piece connected to the diagonal portion, this piece can be adjustable in position relative to the diagonal portion. This allows the end face to be positioned firmly against the exterior wall of the structure, even if the structure has an uneven wall. The end faces can contain a flexible material or pad which allows for proper placement on all types of exterior surfaces, resulting in universal alignment to the outside wall structure.

In one embodiment, there can be a crosspiece connecting the two support legs to one another. This crosspiece can serve as an additional support to the rear of the air conditioner when it is installed.

The adjustable arms can be equipped with a securing mechanism for securing them in a fixed position after adjustment. The securing mechanism can be a plurality of holes on a front surface of the support trough, and a pin extending through each adjustable arm. The pin can be positioned in a selected one of the holes to secure the adjustable arm in a fixed position. This structure can be a spring-based structure so that the pin is automatically fitted in the nearest hole when released. The arms can also have extension wings positioned at the end of each arm. The extension wing is offset from the arms toward the front, so that each wing rests against the front of the window frame when the arms are extended. The wings can be equipped with holes so that they can be secured to the window frame by screws or nails, if desired.

In use, the bracket is positioned in a window frame of a structure such that the support trough fits within the window frame. The support legs are adjusted so that end faces of the support legs rest firmly against an exterior wall of the structure. An air conditioning unit is placed on the base plate such that a front flange of the air conditioning unit fits within the front trough. The adjustable arms are then extended until the adjustable arms abut sides of the window frame and are then locked in place. Then, the side curtains of the air conditioning unit are opened until the side curtains abut the sides of the window frame. Finally, the top sash of the window is lowered until it contacts the air conditioning unit. In this way, the air conditioning unit is securely mounted in the window frame with no air gaps, and no need for drilling holes in the structure or defacing the structure in any way.

The present invention provides features allowing adjustability for myriad window sizes. Another advantage of the present invention is that the bracket is done from interior of building unit, thus avoiding the use of ladders, scaffolding and hoists, etc., ensuring a safe and secure installation. The present invention avoids the use of drilling, tools, fasteners and hardware, resulting in a precise and effective installation while preserving the building integrity and avoiding any damage to the building structure. This is important with apartment rental units, as the tenants are prohibited from damaging the structure.

The present invention provides a way to support an air conditioning unit without placement of various objects on the exterior window sill to fill the space between the underside of the air conditioning unit and the window sill. The bracket securely engages opposite frames of window and properly distributes the weight of air conditioner unit, thus alleviating pressure on window frame.

The adjustable arms allow engagement of the interior window frame when opened outward to its maximum position on opposite ends, securing the bracket without the use of drilling, tools, fasteners and hardware or the like.

Attached to the end of each adjustable arm is a tab that protrudes outward for the purpose of engagement with the outside of window frame. The tabs establish this position after attaining the maximum adjustment of the left and right sill stop resulting in a fixed position.

The function of the adjustable arms with attached tabs is to provide a stable and secure means to safely support the bracket in a single or double hung window that will not shift due to vibration. The base plate, which sits inside the lower window sash, provides means for the side curtains to rest inside sill rail. This arrangement allows bottom of side curtains (left and right side) when extended fully in window frame to remain level with top surface of the bracket, preventing any spaces or voids below the air conditioning unit.

The bracket of the present invention therefore provides a weather-proof fit between the air conditioner unit and the window frame.

The bracket according to the present invention provides additional support by transmitting downward forces to the outwardly extended support legs. Due to the unique angle of the legs, forces applied vertically downward by the air conditioner are absorbed by the bracket, creating horizontally inward forces against the exterior structure, attaining proper balance.

Proper installation includes means to accurately level window support and prevent damage to structure and the possibility of the air conditioner unit falling out of window or into room and to also allow for drainage of condensate.

For safety purposes, the window can be raised while the bracket remains secured with the air conditioner unit in its mounted position. The bracket according to the invention can be constructed of any suitable material, such as metal, a plastic, a rubber, a foam or combination thereof.

The bracket according to the invention will be used primarily in any building, commercial or residential featuring windows that allow for room air conditioner installations. Such installations include but not limited to, coop, condos, apartment buildings, industrial buildings, factories, schools, homes and the like.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
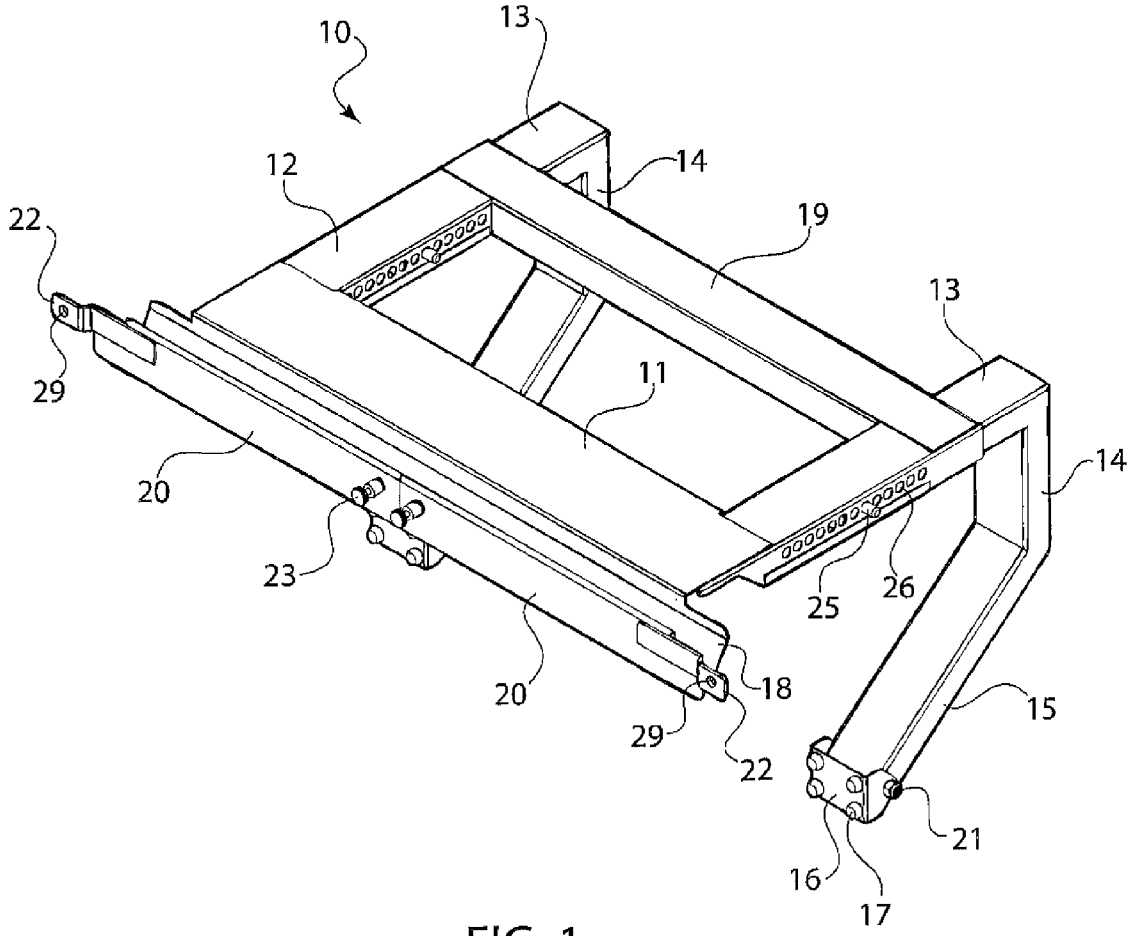
FIG. 1 shows a perspective view of the bracket according to the invention.
Figure 2:
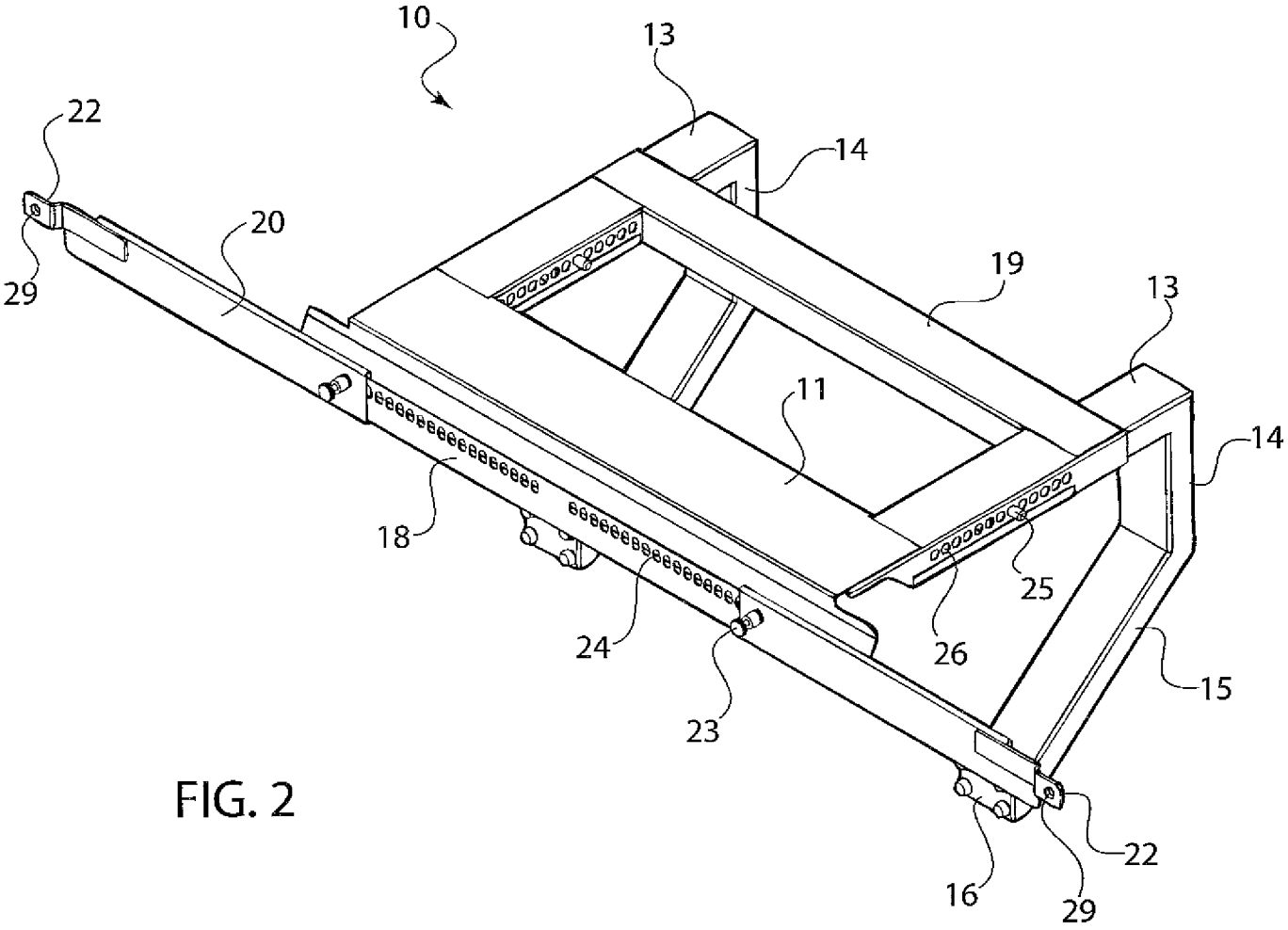
FIG. 2 shows a rear view of the bracket in a window frame with an air conditioner mounted thereon.

Referring now in detail to the drawings and, in particular, FIGS. 1 and 2 show a top view of bracket 10 according to the invention. Bracket 10 comprises a base plate 11 connected to two support legs 12, which are formed by a horizontal portion 13, a vertical portion 14 and a slanted portion 15, all connected together. An end face 16 is connected to the end of slanted portion 15, in a pivotable manner, via screw 21. End caps 17 are affixed around the surface of end face 16 to aid in positioning end face 16 against a wall, as will be described later. Crosspiece 19 connects support legs 12 to provide extra stability as well as extra support for the air conditioner.

Connected to the front edge of base plate 11 is a front trough 18, which has two slidable extension arms 20, secured by spring-loaded pins 23. As shown in FIG. 2, arms 20 are configured to slide outward and be fixed in position by releasing pins 23 at a desired location, where they then seat into one of holes 24 in front trough 18. Also located on arms 20 are extension wings 22, which are offset from arms 20. Wings 22 can be braced against the front of a window frame when arms 20 are extended to rest flush with the interior of the window frame, as described below with respect to FIG. 5. This creates extra stability for the bracket. Wings 22 can be equipped with holes 29, which can be used to secure wings 22 to the window frame via screws or nails, if desired.

The length of legs 12 can be adjusted via spring-loaded pin 25 and holes 26 located along horizontal portion 13. Horizontal portion 13 is configured as telescoping pieces so that the pieces can be adjusted relative to one another to set the length of legs 12. The length of legs 12 needs to be adjustable to adapt to varying building widths.

Figure 3:
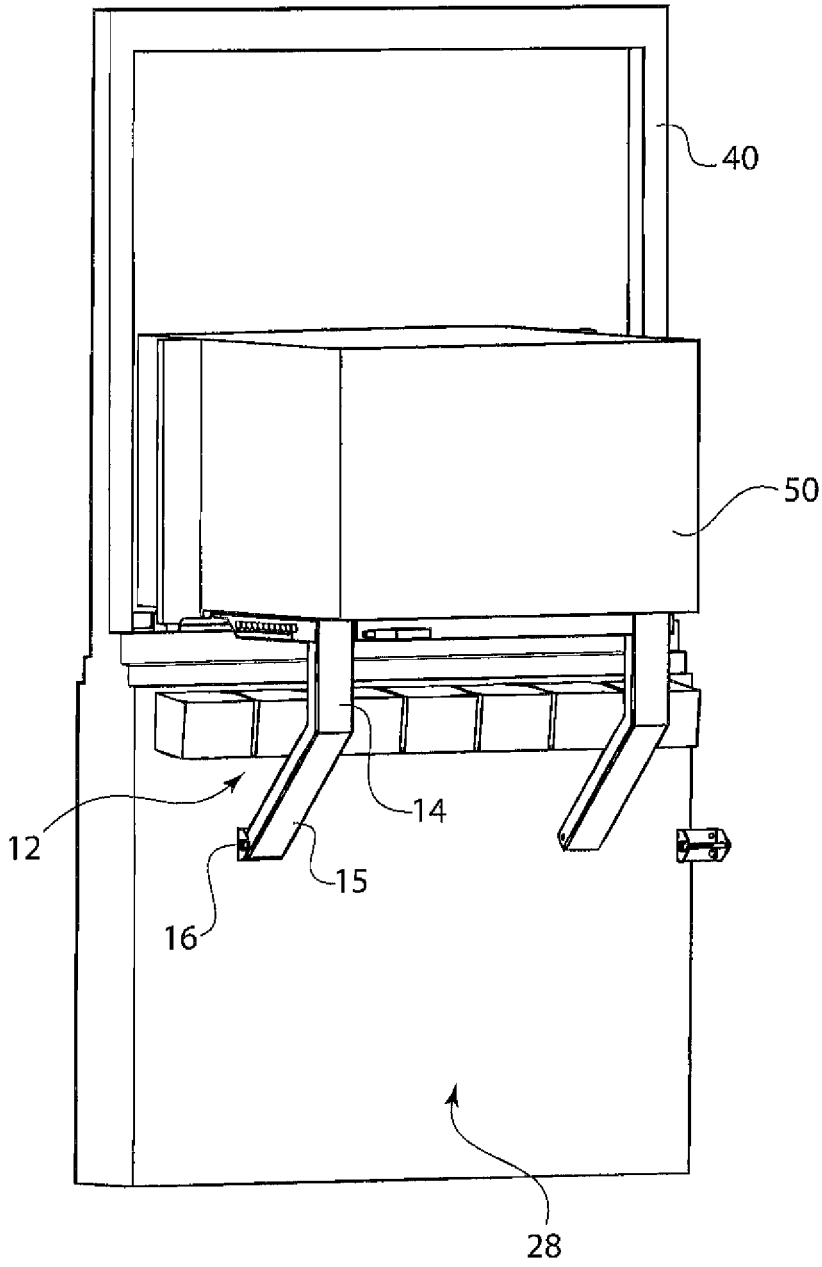
FIG. 3 shows a perspective view of the bracket with the adjustable arms extended.
Figure 4:
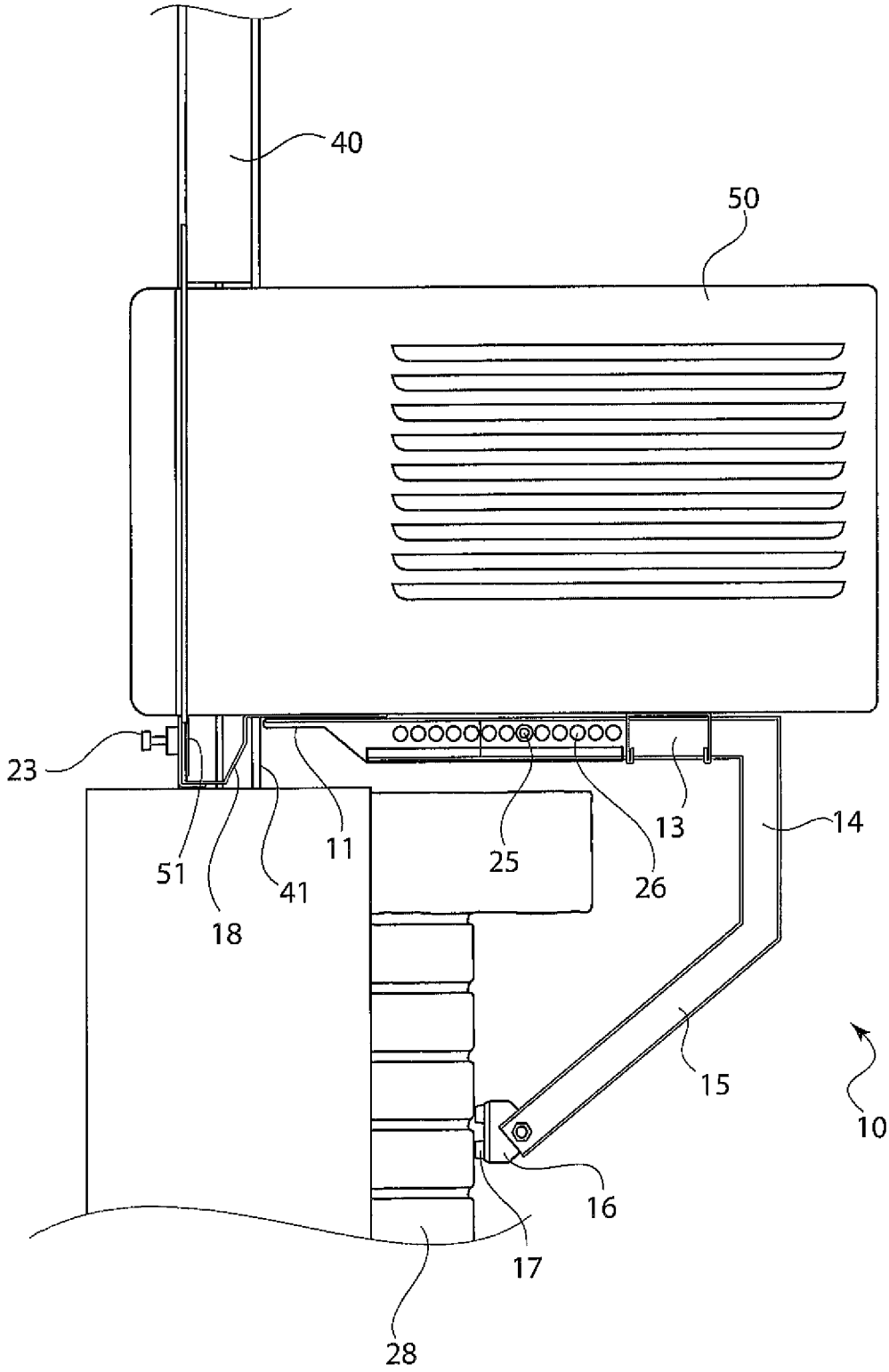
FIG. 4 shows a side cross-sectional view of the bracket in a window frame with an air conditioner mounted thereon.
Figure 5:
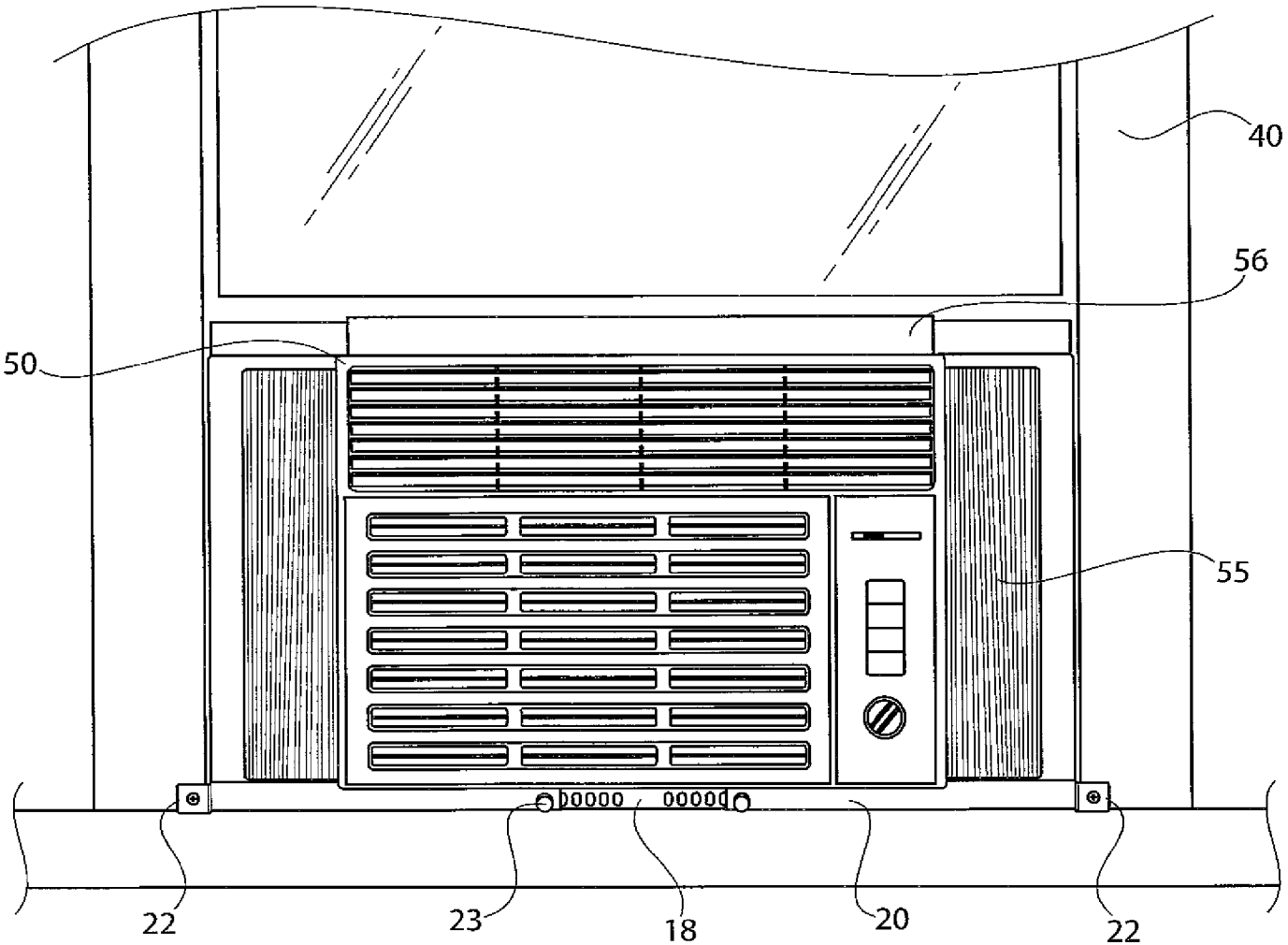
FIG. 5 shows a front view of the bracket in a window frame with an air conditioner mounted thereon.

FIGS. 3-5 show an air conditioner 50 mounted in a window frame 40 using bracket 10. In use, bracket 10 is placed on lower sill 41 of window 40 so that front trough 18 rests within lower sill 41. Then, legs 12 are adjusted using pins 26 so that end faces 16 rest firmly against wall 28. Air conditioner 50 is then placed on top of base plate 11 and legs 12, with front flange 51 of air conditioner 50 resting inside front trough 18, as shown in FIG. 4. The weight of the air conditioner 50 causes a downward force on legs 12, which then causes end faces 16 to be pressed more firmly into the wall 28 of the building. Thus, the heavier the air conditioner, the more support provided by legs 12.

Once air conditioner 50 is set onto bracket 10, arms 20 are then expanded to fill the entire space between the sides of window frame 40, as shown in FIG. 5. Wings 22 are configured to be offset from arms 20 so that they rest firmly against the front of window frame 40 and provide extra support to bracket 10. At that point, side curtains 55 of air conditioner 50 can be extended, also to the complete width of the window frame. Window sash 44 can then be lowered behind top flange 56 of air conditioner 50 in the conventional manner. The bracket according to the invention provides a secure air-tight support for a window air conditioning unit, and does not require any tools or damage to the existing structure to install.

Accordingly, while only a few embodiments of the present invention have been shown and described, it is obvious that many changes and modifications may be made thereunto without departing from the spirit and scope of the invention.

What is claimed is:

1. A bracket for mounting an air conditioning unit in a window, comprising:

a base plate having a front edge and a rear edge;

a pair of support legs connected to the base plate and extending from the rear edge, each support leg having a horizontal portion configured for supporting an air conditioner thereon, and an end face that faces in a same direction as the front edge;

a support trough connected to the front edge; and adjustable arms connected to the support trough, said arms being slidable in opposite directions to increase the width of the bracket;

a securing mechanism comprising a plurality of holes on a front surface of the support trough, and a pin extending through each adjustable arm, wherein the pin is adapted to be positioned in one of the holes to secure the adjustable arm in a fixed position;

wherein when said bracket is positioned in a window frame of a structure, the support trough fits within the window frame, the end faces of the each support leg rest against an exterior of the structure, and wherein a length of the horizontal portions of the support legs are adjustable.

2. The bracket according to claim 1, wherein each support leg is formed by two telescoping parts, and wherein the length is adjustable by adjusting a position of the telescoping parts relative to one another.

3. The bracket according to claim 1, wherein each leg has a vertical portion connected to the horizontal portion, and a diagonal portion connected to the vertical portion and terminating in the end face, such that each leg forms an essentially U shape with the end face extending substantially perpendicular to the horizontal portion.

4. The bracket according to claim 3, wherein the end face is formed by a separate piece connected to the diagonal portion, and being adjustable in position relative to the diagonal portion.

5. The bracket according to claim 1, further comprising a crosspiece connecting the two support legs to one another.

6. The bracket according to claim 1, wherein each adjustable arm has an extension wing connected to an end thereof, each extension wing being offset from said adjustable arm in a direction away from the front trough.

7. The bracket according to claim 6, wherein each extension wing has a hole therethrough for securing the extension wing to a window frame.

8. A method for installing an air conditioning unit in a window frame of a structure, comprising:

positioning a bracket in the window frame, the bracket comprising:

a base plate having a front edge and a rear edge;

a pair of support legs connected to the base plate and extending from the rear edge, each support leg having a horizontal portion configured for supporting an air conditioner thereon, and an end face that faces in a same direction as the front edge;

a support trough connected to the front edge; and adjustable arms connected to the support trough, said arms being slidable in opposite directions to increase the width of the bracket, wherein the bracket is positioned such that the support trough fits within the window frame and the end faces of the support legs rest against an exterior wall of the structure;

adjusting a length of the horizontal portions of the support legs until the end faces rest firmly against an exterior wall of the structure;

placing the air conditioning unit on the base plate and horizontal portions of the support legs such that a front flange of the air conditioning unit fits within the front trough;

extending the adjustable arms until the adjustable arms abut sides of the window frame;

locking the adjustable arms in place using a securing mechanism comprising a plurality of holes on a front surface of the support trough, and a pin extending through each adjustable arm, by positioning each pin in one of the holes to secure the adjustable arms in a fixed position;

opening side curtains of the air conditioning unit until the side curtains abut the sides of the window frame; and lowering a top sash of the window until it contacts the air conditioning unit.

9. The method according to claim 8, further comprising the step of locking the adjustable arms in place after the step of extending.

10. The method according to claim 8, wherein the adjustable arms have extension wings on each end, each extension wing being offset from the respective adjustable arm, and having a hole therethrough, and further comprising the step of securing each extension wing to the window frame through said hole.

* * * * *